United States Patent [19]

Blackman

[11] 4,210,914

[45] Jul. 1, 1980

[54] ROD ANTENNA WITH LOADING COIL AND QUICK-CONNECT COUPLING ASSEMBLY

[75] Inventor: Cornelius P. Blackman, Middleburg Heights, Ohio

[73] Assignee: The Hansen Manufacturing Company, Cleveland, Ohio

[21] Appl. No.: 820,144

[22] Filed: Jul. 29, 1977

[51] Int. Cl.[2] ..... H01Q 1/32

[52] U.S. Cl. ..... 343/715; 343/749

[58] Field of Search ..... 343/701, 702, 715, 749, 343/905, 906, 900; 333/97 R

[56] References Cited

U.S. PATENT DOCUMENTS

| | | | |
|---|---|---|---|
| 2,367,196 | 1/1945 | Butler | 343/901 |
| 2,697,785 | 12/1954 | Stewart | 343/888 |
| 2,911,643 | 11/1959 | Gergely | 343/711 |
| 3,172,109 | 3/1965 | Senrui | 343/901 |
| 3,259,901 | 7/1966 | Bykerk | 343/749 |
| 3,275,970 | 9/1966 | Johanson et al. | 339/45 R |
| 3,323,083 | 5/1967 | Ziegler | 333/97 |
| 3,798,654 | 3/1974 | Martino et al. | 343/750 |
| 3,852,757 | 12/1974 | Kaiser | 343/900 |
| 4,047,779 | 9/1977 | Klancnik | 343/715 |
| 4,058,811 | 11/1977 | Causs et al. | 343/715 |
| 4,063,206 | 12/1977 | Walker | 343/750 |

FOREIGN PATENT DOCUMENTS

| | | | |
|---|---|---|---|
| 1267291 | 5/1968 | Fed. Rep. of Germany | 343/702 |
| 1132565 | 3/1957 | France | 343/901 |

*Primary Examiner*—Eli Lieberman

[57] ABSTRACT

An improved apparatus for use in sending and/or receiving radio frequency electrical signals includes a radio which is connected with an antenna. The antenna includes an antenna rod and a loading coil which are connected with a base by a quick-connective coupling assembly. A second quick-connective coupling assembly is utilized to connect an antenna cable with a terminal on the radio.

8 Claims, 7 Drawing Figures

ROD ANTENNA WITH LOADING COIL AND QUICK-CONNECT COUPLING ASSEMBLY

BACKGROUND OF THE INVENTION

This invention relates to a new and improved apparatus for use in sending and/or receiving radio frequency electrical signals and more particularly to an apparatus wherein one or more quick-connective coupling assemblies are utilized to facilitate interconnection of parts of the apparatus.

Various mounting arrangements have been provided for radio antennas. One known mounting arrangement is disclosed in U.S. Pat. No. 3,544,140. This mounting arrangement includes a spring ring which is utilized to connect an antenna rod with an outwardly projecting mandrel. The antenna rod can be disconnected from the mandrel only by use of a suitable key. Other antenna mounting arrangements are disclosed in U.S. Pat. Nos. 3,699,580; 3,702,480; and 3,899,148.

Antenna cables have been connected with radios by the use of plug and socket connections in the manner disclosed in U.S. Pat. No. 2,911,643. In addition, various arrangements for interconnecting radios and antenna cables are disclosed in U.S. Pat. Nos. 3,364,487 and 3,956,750.

SUMMARY OF THE PRESENT INVENTION

The present invention provides a new and improved apparatus which is utilized in sending and/or receiving radio frequency electrical signals. The apparatus includes a quick-connective coupling assembly between the radio antenna loading coil and a base to enable the antenna to be quickly disconnected from the base. By locating the quick-connective coupling assembly between the antenna loading coil and the base, the coupling assembly does not interfere with the electrical characteristics of the antenna. If the quick-connective coupling assembly were located between the antenna rod and the loading coil, the characteristics of the antenna would be modified due to the impedance of the quick-connective coupling assembly.

The present invention also contemplates that a quick-connective coupling assembly may advantageously be utilized between an antenna cable and a terminal of a radio. This quick-connective coupling assembly enables the radio to be readily disconnected from the antenna cable when the radio is not in use. When the radio is to be subsequently utilized, the quick-connective coupling assembly between the antenna cable and radio terminal enables the antenna cable to be quickly and easily connected.

Accordingly, it is an object of this invention to provide a new and improved apparatus for sending and/or receiving radio frequency electrical signals wherein the apparatus includes a quick-connective coupling assembly disposed between an antenna loading coil and an antenna base to enable the antenna loading coil and associated antenna rod to be quickly disconnected from and reconnected with the base.

Another object of this invention is to provide a new and improved apparatus for use in sending and/or receiving radio frequency electrical signals wherein the apparatus includes a quick-connective coupling assembly which interconnects an antenna cable and radio terminal to enable the antenna cable to be quickly disconnected from and reconnected with the radio terminal.

Another object of this invention is to provide a new and improved apparatus for use in sending and/or receiving radio frequency electrical signals wherein the apparatus includes a pair of quick-connective coupling assemblies, one of the coupling assemblies being utilized to connect an antenna loading coil with an antenna base and the other coupling assembly being utilized to connect an antenna cable with a radio terminal.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
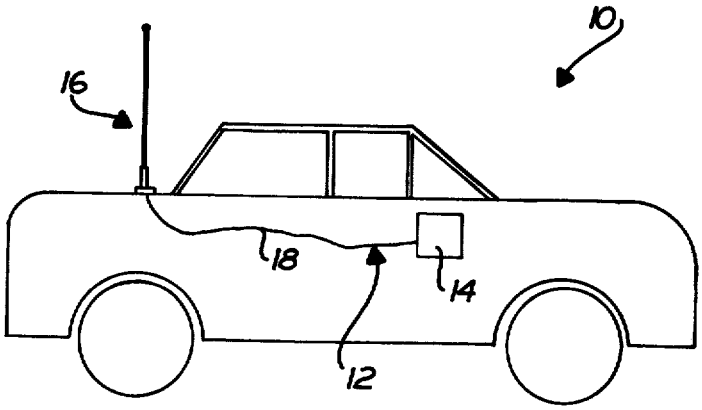
FIG. 1 is a schematic illustration of a vehicle having a radio connected with an antenna by a cable.

A vehicle 10 (FIG. 1) is provided with an apparatus 12 for use in sending and/or receiving radio frequency electrical signals. The apparatus 12 includes a radio 14 which is connected with an antenna 16 by an antenna cable 18. During operation of the radio 14, the antenna 16 is utilized to send and receive radio frequency electrical signals in a well known manner.

Figure 2:
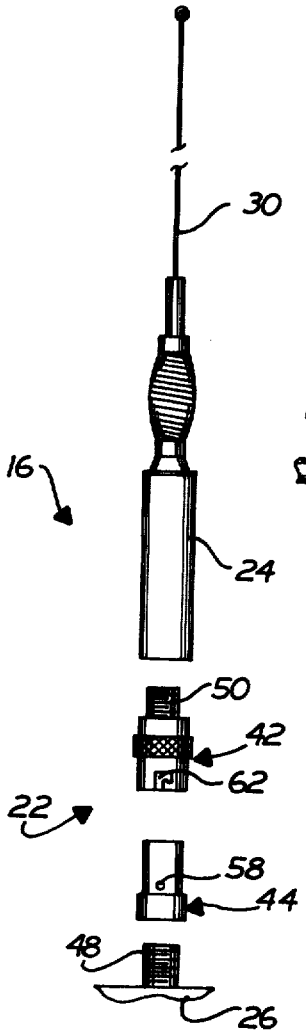
FIG. 2 is a partially exploded schematic illustration depicting the manner in which a quick-connective coupling assembly is utilized to connect a loading coil of the antenna with a base.

In accordance with a feature of the present invention, a quick-connective coupling assembly 22 (FIG. 2) is utilized to connect an antenna loading coil 24 with an antenna base 26. The antenna loading coil 24 increases the effective electrical length of the antenna 16 which has a relatively short antenna rod 30. The quick-connective coupling assembly 22 is located between the cylindrical loading coil 24 and the antenna base 26 so as not to affect the electrical characteristics of the antenna adversely. If the quick-connective coupling assembly 22 is located between the antenna rod 30 and the loading coil 24, the impedance of the quick-connective coupling assembly would affect the electrical characteristics of the antenna 16.

Figure 6:
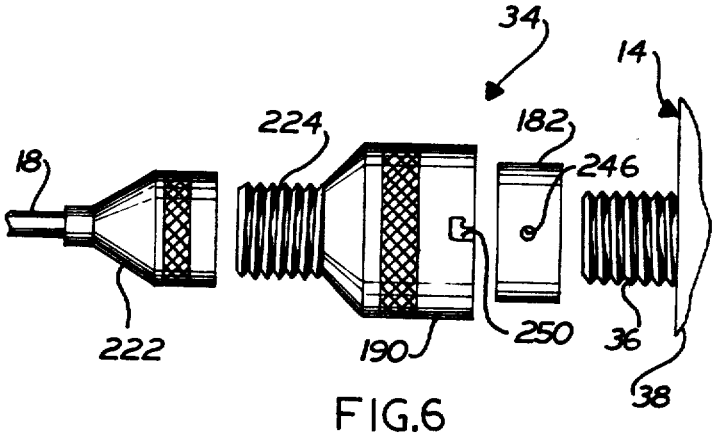
FIG. 6 (on the first sheet of drawings) is a partially exploded schematic illustration of the manner in which a quick-connective coupling assembly is utilized to connect an antenna cable with a radio terminal.

In accordance with another feature of the present invention, a quick-connective coupling assembly 34 (see FIG. 6) is utilized to connect the antenna cable 18 with a terminal 36 projecting outwardly from the housing or casing 38 of the radio 14. The two quick-connective coupling assemblies 22 and 34 enable the antenna 16 and radio 14 to be quickly disconnected from the antenna cable 18. The radio and/or the antenna can be stored in a suitable location to prevent theft of the radio 14 and/or antenna 16 when the vehicle is parked. When it is desired to reinstall the radio 14 and antenna 16 on the vehicle 10, it is merely necessary to utilize the quick-connective coupling 22 to connect the antenna with the vehicle mounted base 26 and to use the coupling 34 to connect the antenna cable 18 with the radio 14. The use of the quick-connective coupling assemblies 22 and 34 greatly facilitates the removal and subsequent and reinstallation of the antenna 16 and radio 14.

The quick-connective coupling assembly 22 includes a socket assembly 42 (see FIG. 3) which telescopically receives a plug assembly 44. Internal threads 46 on the plug assembly 44 engage external threads 48 on the antenna base 26 to interconnect the base and plug assembly. Similarly, external threads 50 on the socket assembly 42 engage internal threads 52 on the lower end portion of the loading coil 24 to interconnect the socket assembly 42 and loading coil.

When the plug and socket assemblies 44 and 42 are connected, they are held against axial movement relative to each other by a retainer or detent assembly 56. The retainer assembly 56 includes a pin 58 which extends radially outwardly from a generally cylindrical plug body 60 into engagement with a J-shaped recess 62 formed in a socket body 64.

The quick-connective coupling assembly 22 enables the antenna 16 to be quickly and easily disconnected from the base 26. This is done by manually grasping the loading coil 24 and pushing it downward to release the pin 58 from a detent portion of the recess 62. The loading coil is then turned counterclockwise through an arcuate distance of approximately 24° and lifted upwardly to disengage the socket assembly 42 from the plug assembly 44. The plug assembly 44 remains on the base 26 which is fixedly connected with the vehicle 10. The socket assembly 42 remains connected with the loading coil 24 and antenna rod 30.

When the antenna 16 is to be reconnected with the base 26, the foregoing procedure is reversed. Since the socket assembly 42 can be quickly and easily disconnected from and connected with the plug assembly 44, the disconnection and reinstallation of the antenna 16 requires a minimum of time and effort. The manner in which the detent pin 58 cooperates with the slot 62 is the same as is described in U.S. Pat. No. 2,896,977. Of course other known types of detent assemblies could be utilized if desired.

The plug assembly 44 includes an axially extending central conductor 66 which is electrically insulated from the metallic plug body 60 by a body 68 of electrically insulating material. The electrically insulating material 68 has a cylindrical main section 70 which presses against a similarly shaped inner surface 72 of the plug body 60. A circular rim or flange 74 is formed on the main section 70 and cooperates with an annular recess 75 in the plug body. The plug conductor 66 has a central portion 78 with circular barbs 80 which engage a cylindrical passage 82 formed in the insulating material 68 to hold the conductor against axial movement relative to the plug body 60.

An outer end portion 86 of the plug conductor 66 is formed with a cylindrical socket 88. The socket 88 telescopically receives and grips a base conductor 90 to provide a firm electrical connection between the base conductor 90 and the plug conductor 66. A body 94 of suitable material is effective to electrically insulate the base conductor 90 from a metallic base housing 92.

The socket assembly 42 includes a central conductor 98 which is axially aligned with the plug conductor 66 and is disposed in a body 100 of electrically insulating material. The socket conductor 98 has a central portion 102 with circular barbs 104 which engage the body 100 of electrically insulating material to hold the socket conductor against axial movement relative to the socket body 64. The socket conductor 98 has an outwardly projecting plug end portion 106 which is telescopically received in a cylindrical socket 108 formed in a loading coil conductor 110. When the end portion 106 of the socket conductor 98 is telescopically inserted into the socket 108 in the loading coil conductor 110, a firm electrical connection is established between the loading coil conductor 110 and the socket conductor 98.

Although the socket assembly 42 has been shown spaced apart from the loading coil 24 and the plug assembly 44 has been shown spaced apart from the base 26, it is contemplated that the socket assembly will be more or less permanently connected with the loading coil by the threads 50 and 52 and that the plug assembly will be more or less permanently connected with the base by the threads 46 and 48. When the antenna 16 is to be disconnected from the base 26 and stored, the socket assembly 42 is disconnected from the plug assembly 44 while the connections between the socket assembly 42 and loading coil 24 and plug assembly 44 and base 26 are maintained. Similarly, it is contemplated that the antenna 16 will be reinstalled on the base 26 by interconnecting the plug and socket assemblies 42 and 44 without disturbing the connection between the loading coil 24 and socket assembly 42 and the connection between the plug assembly 44 and the base 26.

Figure 3:
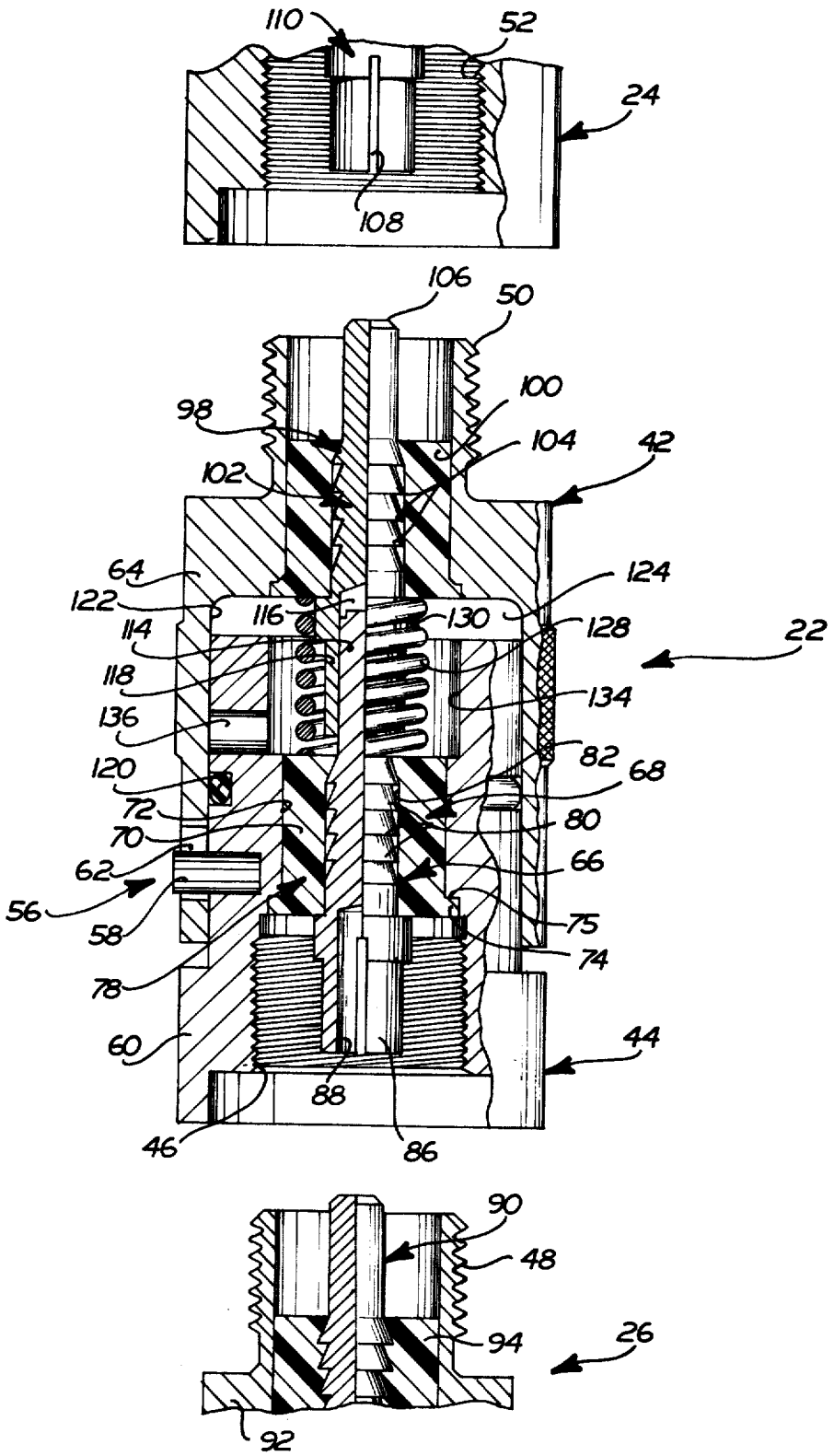
FIG. 3 is an enlarged fragmentary sectional view illustrating the manner in which the plug and socket assemblies of the quick-connective coupling of FIG. 2 are interconnected.

To provide a solid electrical connection between the plug conductor 66 and the socket conductor 98 when the plug and socket assemblies 42 and 44 are interconnected in the manner shown in FIG. 3, the plug conductor 66 has a cylindrical upper end portion 114 which is telescopically received in a cylindrical socket 116 formed in a lower end portion 118 of the socket conductor 98. When the plug and socket conductors 66 and 98 are interconnected in this manner, the plug conductor is firmly gripped by the socket conductor to provide an electrical connection between them. An O-ring seal 120 disposed in an annular groove on the plug body 60 engages a cylindrical inner surface 122 of the socket body 64 to prevent leakage of water between the plug and socket assemblies. Thus, when the plug assembly 44 is telescopically disposed in a cylindrical socket chamber 124 in the manner illustrated in FIG. 3, the interconnection between the plug and socket conductors 66 and 98 is protected from moisture in the surrounding environment.

To maintain the detent pin 58 in engagement with the J-shaped opening 62 in the socket body 64, a coil spring 128 is effective to urge the socket body away from the plug body 60. The coil spring 128 circumscribes and is coaxial with the end portion 118 of the socket conductor 98. The coil spring 128 is held on the socket conductor 98 by frictional gripping engagement of turns of the spring closely adjacent to the body of insulating material 100 with an enlarged cylindrical portion 130 of the socket conductor.

When the socket assembly 42 is disconnected from the plug assembly 44, a cylindrical recess 134 in the socket body faces upwardly. To prevent the accumulation of water in the cylindrical recess 134, a radially extending drain hole 136 is formed in the plug body 60. If the drain opening 136 is omitted, water would accumulate around the outer end portion 114 of the plug conductor 66 when the socket assembly 42 is disconnected from the plug assembly 44.

When the plug assembly 44 has been connected with the base 26 and with the socket assembly 42 and the socket assembly 42 has been connected with the loading coil 24, they cooperate to connect the antenna rod 30 and loading coil 24 (see FIG. 2) in electrical communication with the antenna cable 18. This enables radio frequency electrical signals to be conducted between the antenna rod 30 and the radio 14. Since the quick-disconnect coupling assembly 22 is disposed between the loading coil 24 and base 26, the tuned characteristics of the antenna 16 are unchanged. This is because the quick-connective coupling assembly 22 is in a low impedance part of the antenna connection with the radio 14.

Although it is contemplated that the radio 14 will be capable of both sending and receiving radio frequency electrical signals conducted through the quick-connective coupling assembly 22, the antenna 16 and quick-connective coupling assembly could be utilized in association with a radio which is used only for reception of radio signals or in association with the radio which is used only for transmitting radio signals. Although the radio 14 and antenna 16 have been illustrated in FIG. 1 as being installed on a vehicle, it is contemplated that the quick-connective coupling assembly could be utilized in association with a base station antenna.

Figure 4:
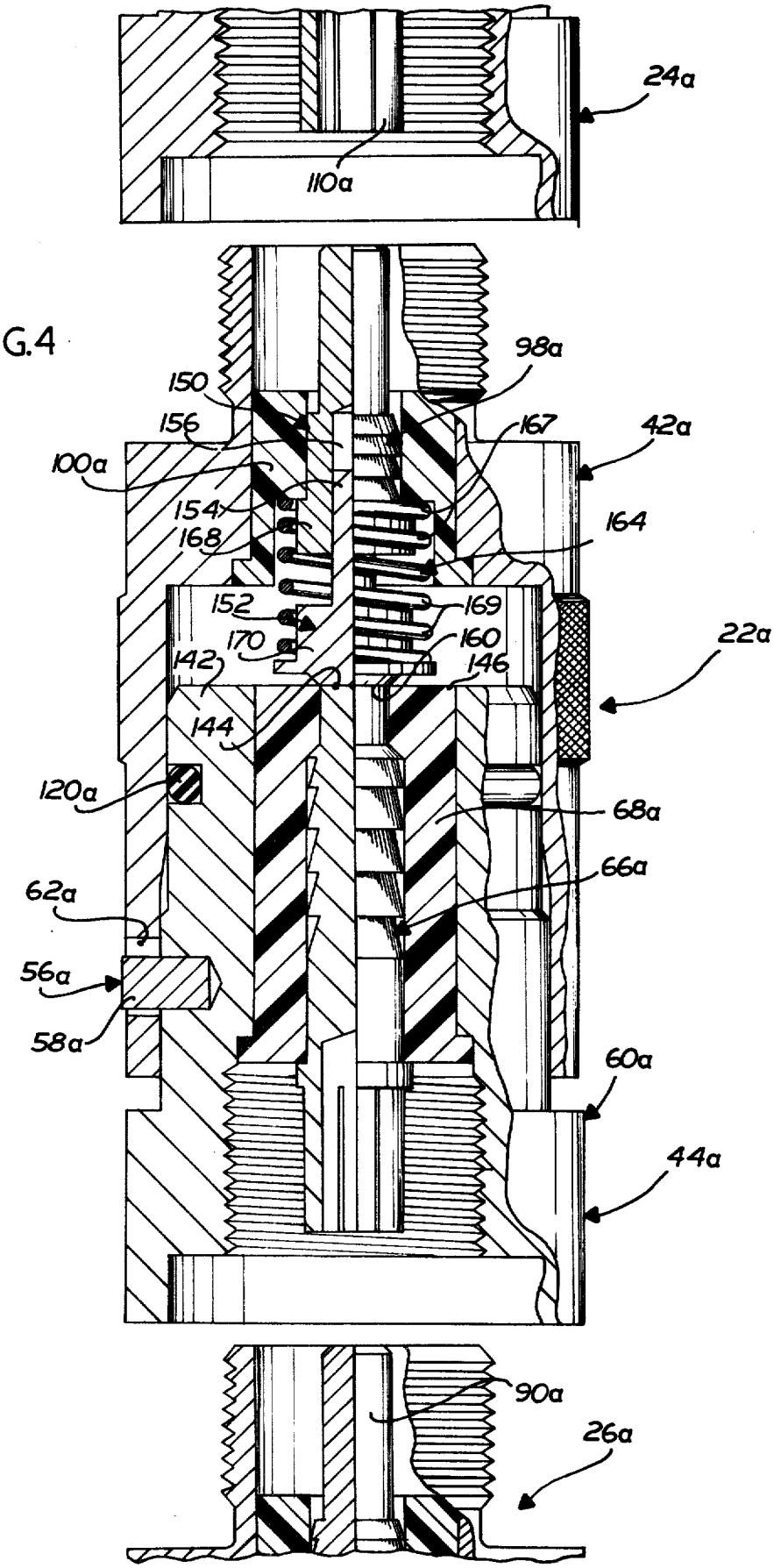
FIG. 4 is an enlarged sectional view, generally similar to FIG. 3, illustrating the manner in which a second embodiment of the plug and socket assemblies are interconnected.

The quick-connective coupling assembly 22 has a recess 134 in which moisture, dirt and foreign materials may tend to accumulate in spite of the drain opening 136. Therefore, it is believed that it may be preferred to have a plug assembly with an outer end portion which presents a surface free of recesses to prevent the accumulation of foreign materials. Such a plug assembly is disclosed in the embodiment of the invention illustrated in FIG. 4. Since the embodiment of the invention illustrated in FIG. 4 is generally similar to the embodiment of the invention illustrated in FIG. 3, similar numerals are utilized to designate similar components, the suffix letter "a" being associated with the embodiment of FIG. 4 to avoid confusion.

A quick-connective coupling assembly **22*a* (FIG. 4) is utilized to interconnect an antenna loading coil 24*a* and base 26*a*. The coupling assembly 22*a* includes a plug assembly 44*a* which is connected with the base 26*a* and a socket assembly 42*a* which is connected with the loading coil 24*a* in the same manner as previously explained in connection with the quick-connective coupling assembly of FIG. 3**.

The plug assembly **44*a* has a generally cylindrical body 60*a* with annular end face 142. A metal plug conductor 66*a* is disposed in a coaxial relationship with the plug body 60*a*. The plug conductor 66*a* has a circular end face 144 which is disposed in a coplanar relationship with the annular end face 142 of the plug body 60*a*. A cylindrical body of insulating material 68*a* disposed between the conductor 66*a* and plug 60*a*. The body of insulating material 68*a* has an annular end surface 146 which is disposed in a coaxial relationship with the end faces 142 and 144 of the plug body 60*a* and conductor 66*a*. This results in the plug assembly 44*a*** having a smooth end surface which is free of recesses in which foreign materials can accumulate.

In order to provide a solid electrical connection between the plug conductor **66*a* and a socket conductor 98*a*, the socket conductor is firmly pressed against the plug conductor. The socket conductor 98*a* has a two-part construction with a base section 150 fixedly mounted in a body 100*a* of insulating material. A movable section 152 of the conductor 98*a* has a cylindrical end portion 154 which is telescopically received in a socket 156 formed in the base section 150. A circular end face 160 on the movable conductor section 152 is pressed against the circular end face 144 of the plug conductor 66*a* by a coil spring 164. The coil spring 164 also functions to urge the plug and socket assemblies apart to maintain a firm connection between the pin 58*a* and J-shaped slot 62*a* of the retainer assembly 56*a***.

When the plug and socket assemblies **44*a* and 42*a* are disconnected, the coil spring 164 holds the movable conductor section 152 in engagement with the stationary conductor section 150. To this end, the inner coils 167 of the spring 164 securely grip a cylindrical outer end portion 168 of the stationary conductor section 150. The outer turns 169 of the coil spring 164 securely grip a cylindrical portion 170 of the movable conductor section 152. Thus, the coil spring 164 performs the three-fold functions of pressing the movable section 152 of the socket conductor 98*a* into firm abutting engagement with the plug conductor 66*a*, urging the plug and socket assemblies 44*a* and 42*a* apart to maintain a firm connection at the retainer assembly 56*a*, and retaining the movable conductor section 152 in telescopic engagement with the fixed conductor section 150 when the plug and socket assemblies 44*a* and 42*a*** are disconnected.

Figure 5:
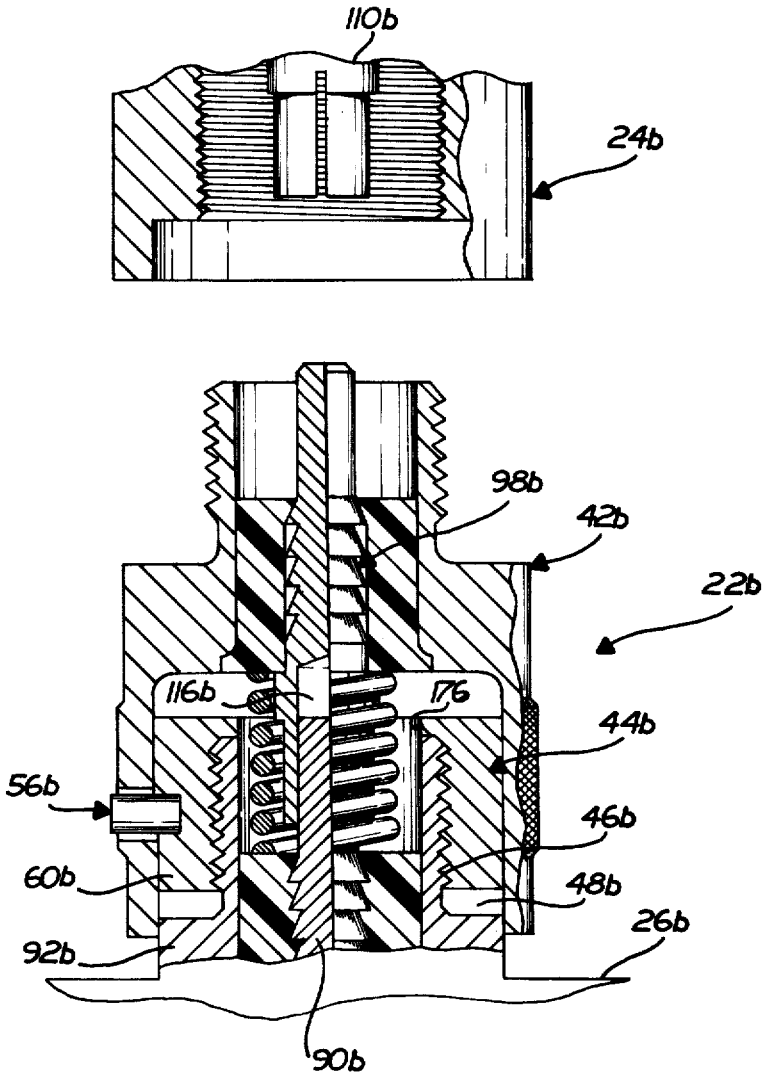
FIG. 5 is an enlarged sectional view generally similar to FIGS. 3 and 4, illustrating the manner in which another embodiment of the plug and socket assemblies are connected with an antenna base.

It is contemplated that it may be desirable to simplify the construction of the plug assemblies 44 and **44*a* of FIGS. 3 and 4 to reduce the cost of manufacture of the quick-connective coupling assemblies. This could be done by connecting the socket conductor directly with the base conductor in the manner as illustrated in FIG. 5. Since the embodiment of the invention shown in FIG. 5 is generally similar to the embodiments of the invention shown in FIGS. 3 and 4, similar numerals will be utilized to designate similar components, the suffix "b" being associated with the components of FIG. 5** to avoid confusion.

A quick-connective coupling assembly **22*b* (FIG. 5) is connected with an antenna loading coil 24*b* and base 26*b*. The quick-connective coupling assembly 22*b* includes a socket assembly 42*b* which is connected with the loading coil 24*b* in the manner previously explained in connection with the embodiment of the invention as illustrated in FIG. 3. The plug assembly 44*b* includes a plug body 60*b* having internal threads 46*b* which engage external threads 48*b* on the base housing 92*b*. The plug body 60*b* has the configuration of a cylindrical sleeve and does not have a plug conductor as do the embodiments illustrated in FIGS. 3 and 4**.

The socket assembly **42*b* has a socket conductor 98*b* which extends through a circular opening 176 formed in the plug body 60*b*. The conductor 98*b* has a cylindrical socket 116*b* which telescopically receives a cylindrical outer end portion of the base conductor 90*b*. The opposite end of the conductor 98*b* is telescopically received in a socket in the loading coil conductor 110*b***.

When the socket assembly 42b is connected wtih the loading coil 24b and the plug assembly 44b, the socket conductor 98b provides a direct electrical connection between the base conductor 90b and the loading coil conductor 110b. The loading coil conductor 110b is electrically connected with the loading coil 24 (see FIG. 2) and an antenna rod 30. Similarly, the base conductor 90b is directly connected with the antenna cable 18. Therefore, a path for transmitting radio frequency electrical signals is provided between the antenna 16 and radio 14 by the quick-connective coupling assembly 22b.

Figure 7:
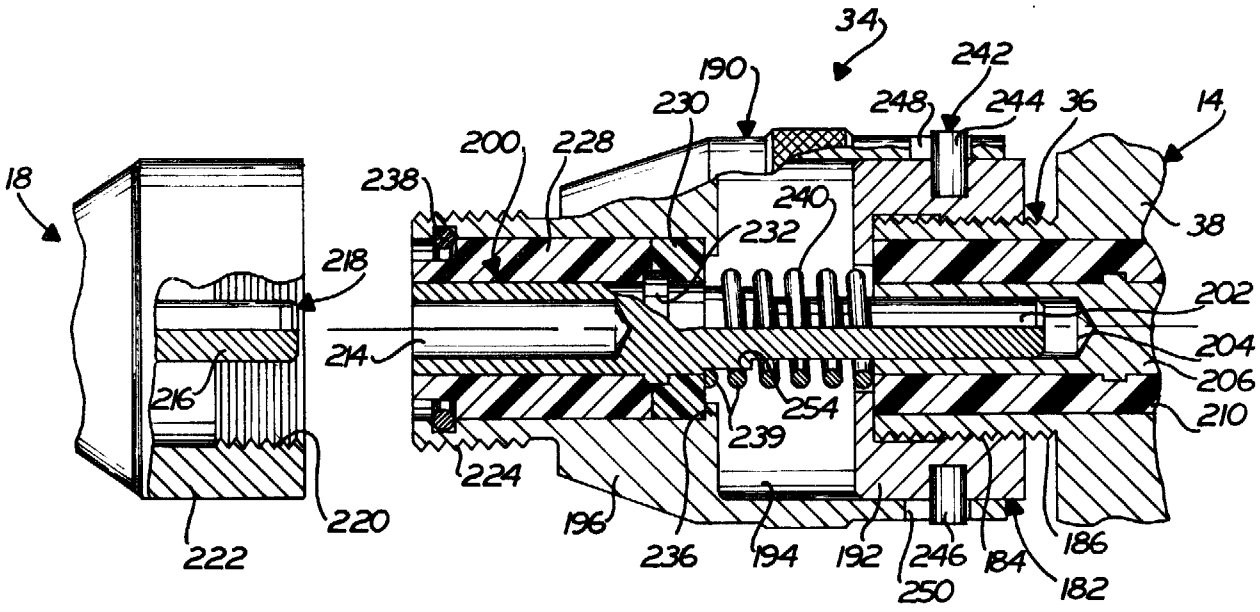
FIG. 7 is a enlarged sectional view illustrating the manner in which the plug and socket assemblies of the quick-connective coupling assembly of FIG. 6 are connected with the radio terminal.

The manner in which the quick-connective coupling assembly 34 (FIG. 6) connects the antenna cable 18 in electrical communication with the radio terminal 36 is illustrated in FIG. 7. The quick-connective coupling assembly 34 includes a plug assembly 182 having internal threads 184 which engage external threads 186 on a radio terminal 36. A socket assembly 190 telescopically receives a cylindrical plug body 192 in a cylindrical socket chamber 194 formed in a metallic socket body 196.

The socket assembly 190 includes a central conductor 200 having a cylindrical outer end portion 202. The cylindrical outer end 202 of the socket conductor 200 is telescopically received in a cylindrical socket 204 formed in a radio terminal conductor 206. The radio terminal conductor 206 is electrically insulated from the radio housing 38 by a body 210 of insulation.

The opposite end of the socket conductor 200 is provided with a cylindrical socket 214. The socket 214 telescopically receives a cylindrical end portion 216 of an antenna cable conductor 218. To connect the antenna cable 18 with the socket assembly 190, internal threads 220 on an antenna cable housing 222 are connected with external threads 224 on the socket body 196.

The socket conductor 200 is electrically insulated from and held against axial movement relative to the socket body 196 by a pair of cylindrical sections 228 and 230 of electrically insulating material. The two cylindrical sections 228 and 230 engage opposite sides of annular flange 232 formed on the socket conductor 200. The inner section 230 of material abuts an annular flange 236 formed on the socket body 196. A snap ring 238 abuts the outer end of the cylindrical section 228 to hold it in place.

A coil spring 240 is disposed in a coaxial relationship with the socket conductor 200 and is effective to urge the plug and socket assemblies 182 and 190 apart to maintain a firm connection at a retainer assembly 242. The retainer assembly 242 is of the same construction as the retainer assembly 56 of FIG. 3 and includes a pair of cylindrical detent pins 244 and 246 which extend into J-shaped slots 248 and 250 formed in the socket housing 196. The inner turns 239 of the coil spring 240 grip a cylindrical section 254 of the socket conductor 200 to hold the coil spring in place when the plug and socket assemblies 182 and 190 are disconnected.

In view of the foregoing description, it is apparent that an improved apparatus for use in sending and/or receiving radio frequency electrical signals includes an antenna 16 which is connected with a radio 14 by a cable 18. A quick-connective coupling assembly 22 is provided between the antenna loading coil 24 and base 26 to enable the antenna loading coil 24 and antenna rod 30 to be quickly and easily disconnected from the base. The quick-connective coupling assembly 22 includes a plug assembly 44 which is connected with the base 26. The quick-connective coupling assembly 22 also includes a socket assembly 42 which is connected with the antenna loading coil 24. The plug assembly is telescopically received in the socket assembly 42. It is held in place by retaining assembly 56 during use of the radio 14. Although the plugs and sockets of the quick-connective couplings illustrated in the drawings have been connected with the antenna loading coils and bases with threaded connections, it may be desirable to connect the plugs and sockets with the antenna loading coils and base, by forming the plugs and sockets integrally with the antenna components.

When it is desired to store the antenna 16, the socket assembly 42 is disconnected from the plug assembly 44. This releases the socket assembly 42, loading coil 24 and antenna rod 30 for movement away from the base 26 to a suitable storage location. When the radio is to again be used, the socket assembly 42 is quickly and easily connected with the plug assembly 44 to connect the antenna rod 30 and loading coil 24 in electrical communication with the antenna cable 18.

A quick-connective coupling assembly 34 is also utilized to connect the antenna cable 18 with the radio terminal 36. The quick-connective coupling assembly 34 includes a plug assembly 182 which is fixedly connected with the radio terminal 36. A socket assembly 190 is fixedly connected with one end of the antenna cable 18. When the radio 14 is being used, the plug assembly 182 is telescopically received within the socket assembly 190 to maintain an electrical connection between the antenna cable 18 and terminal 36. When the antenna cable 18 is to be disconnected from the radio 14 to enable it to be moved to a suitable storage location, the plug assembly 190 is disconnected from the socket assembly 182.

It should be understood that although the plug and socket assemblies illustrated in the drawings are connected with each other by a specific retaining assembly, other types of retaining assemblies could be utilized if desired. For example, the quick-connective coupling assembly disclosed in U.S. Pat. No. 2,761,469 could be used. It should also be understood that although the quick-connective coupling assembly 22 is advantageously utilized in association with an antenna having a base loading coil 24, the quick-connective coupling assembly 22 could be utilized in association with a center loaded antenna if desired. Although both of the quick-connective coupling assemblies 22 and 34 are advantageously utilized in association with the same radio 14 and antenna 16 it is contemplated that it may be desired to use only one of the quick-connective coupling assemblies rather than both of them. For example, it may be desirable to use only the quick-connective assembly 22 in association with the antenna 16 while the radio 14 is permanently mounted in a vehicle. Similarly, it may be desirable to use only the quick-connective coupling assembly 34 when the antenna 16 is to remain permanently mounted on the vehicle.

Having described specific preferred embodiments of the invention, the following is claimed:

1. An apparatus for use in sending and/or receiving radio frequency electrical signals, said apparatus comprising a base having a conductor element, an antenna, loading coil means connected to one end of said antenna for increasing the effective electrical length of said antenna, and a quick-connective coupling assembly interconnecting said base and said loading coil means, said quick-connective coupling assembly including plug and socket assemblies connected with said base and loading coil means, said socket assembly including surface means for defining a chamber to telescopically receive at least a portion of said plug assembly and retaining means for holding said plug and socket assemblies against axial movement relative to each other, said plug assembly including first conductor means having first and second end portions, said first end portion being disposed in engagement with said conductor element to provide for the conduction of radio frequency electrical signals between said plug assembly and base, a plug body circumscribing said first conductor means, and electrically insulating material disposed between said first conductor means and said plug body, said electrically insulating material having an end surface which cooperates with an end surface of said plug body and an end surface of said second end portion of said first conductor means to form a smooth end portion of said plug assembly to retard the accumulation of foreign materials on the end portion of said plug assembly, said socket assembly including second conductor means having a first end portion disposed in engagement with said end surface of said second end portion of said first conductor means to provide for the conduction of radio frequency electrical signals between said first and second conductor means, said second conductor means having a second end portion disposed in engagement with said loading coil means to provide for the conduction of radio frequency electrical signals between said second conductor means and said loading coil means, a socket body circumscribing said second conductor means, and electrically insulating material disposed between said second conductor means and said socket body, said second conductor means including a first conductor member which is movable relative to said socket housing and a second conductor member which is fixedly connected with said socket housing and is connected with said first conductor member, said first end portion of said second conductor means being disposed on said first conductor member, said second end portion of said second conductor means being disposed on said second conductor member.

2. An apparatus as set forth in claim 1 wherein said socket assembly includes spring means for providing a spring force tending to reduce the telescopic relationship between said plug and socket assemblies, said retaining means being effective to hold said plug and socket assemblies in telescopic engagement against the influence of said spring means.

3. An apparatus as set forth in claim 1 wherein said second conductor member includes socket means for telescopically receiving said first conductor member, said first conductor member being movable relative to said second conductor member to vary the telescopic relationship between said first and second conductor members.

4. An apparatus as set forth in claim 3 further including spring means for providing a force tending to reduce the telescopic relationship between said first and second conductor members and for holding said first conductor member in engagement with said second conductor member when said coupling assembly is in a disconnected condition.

5. An apparatus as set forth in claim 1 wherein said base includes an external thread convolution, said loading coil means including an internal thread convolution, one of said plug and socket assemblies including an internal thread convolution disposed in engagement with the external thread convolution on said base and the other of said plug and socket assemblies including an external thread convolution disposed in engagement with the internal thread convolution on said loading coil means.

6. An apparatus for use in sending and/or receiving radio frequency electrical signals, said apparatus comprising a base having a conductor element, an antenna, loading coil means connected to one end of said antenna for increasing the effective electrical length of said antenna, and a quick-connective coupling assembly interconnecting said base and said loading coil means, said quick-connective coupling assembly including plug and socket assemblies connected with said base and loading coil means, said socket assembly including surface means for defining a first chamber to telescopically receive at least a portion of said plug assembly and retaining means for holding said plug and socket assemblies against axial movement relative to each other, said plug assembly including first conductor means having first and second end portions, said first end portion being disposed in engagement with said conductor element to provide for the conduction of radio frequency electrical signals between said plug assembly and base, a plug body circumscribing said first conductor means, and electrically insulating material disposed between said first conductor means and said plug body, said socket assembly including second conductor means having a first end portion with surface means defining a second chamber disposed within said first chamber, said second end portion of said first conductor means being telescopically disposed in said second chamber in abutting engagement with said surface means to provide a firm electrical contact therebetween and to provide for the conduction of radio frequency electrical signals between said first and second conductor means, said second conductor means having a second end portion disposed in engagement with said loading coil means to provide for the conduction of radio frequency electrical signals between said second conductor means and said loading coil means, a socket body circumscribing said second conductor means, electrically insulating material disposed between said second conductor means and said socket body, and a coil spring, said coil spring having a first end portion disposed in resilient gripping engagement with said second conductor means and a second end portion disposed in abutting engagement with said electrically insulating material disposed between said first conductor means and said plug body.

7. An apparatus as set forth in claim 6 wherein said plug body includes a sidewall which extends axially outwardly from said electrically insulating material disposed between said first conductor means and said plug body, said sidewall of said plug body defining a third chamber, said sidewall of said plug body including means defining a drain opening extending between said third chamber and an outer side surface of said plug body to prevent the accumulation of liquid in said third chamber.

8. An apparatus for use in sending and/or receiving radio frequency electrical signals, said apparatus comprising a base having a conductor element, an antenna, loading coil means connected to one end of said antenna for increasing the effective electrical length of said antenna, and a quick-connective coupling assembly interconnecting said base and said loading coil means, said quick-connective coupling assembly including plug and socket assemblies connected with said base and loading coil means, said socket assembly including surface means for defining a chamber to telescopically receive at least a portion of said plug assembly and retaining means for holding said plug and socket assemblies against axial movement relative to each other, said plug assembly including first conductor means having first and second end portions, said first end portion being disposed in telescopic engagement with said conductor element to provide for the conduction of radio frequency electrical signals between said plug assembly and base, a plug body circumscribing said first conductor means, and electrically insulating material disposed between said first conductor means and said plug body, said first end portion of said first conductor means extending outwardly from said electrically insulating material and including surface means for defining a chamber to telescopically receive said conductor element, said socket assembly including second conductor means having a first end portion disposed in engagement with said second end portion of said first conductor means to provide for the conduction of radio frequency electrical signals between said first and second conductor means, said second conductor means having a second end portion disposed in engagement with said loading coil means to provide for the conduction of radio frequency electrical signals between said second conductor means and said loading coil means, a socket body circumscribing said second conductor means, electrically insulating material disposed between said second conductor means and said socket body, and coil spring means circumscribing and disposed in engagement with said second conductor means for applying a force to said plug and socket assemblies urging said plug and socket assemblies apart, said retaining means being operable between a first condition in which said retaining means is effective to hold said plug and socket assemblies against movement relative to each other under the influence of said spring means and a second condition in which said retaining means is ineffective to hold said plug and socket assemblies against movement relative to each other under the influence of said spring means.

* * * * *